United States Patent [19]

Wüstmann et al.

[11] Patent Number: 5,074,425

[45] Date of Patent: Dec. 24, 1991

[54] PLASTIC CLOSURE CAP

[75] Inventors: Günter Wüstmann, Hüuxe-Drevenack; Michael Kirchgessner, Binzen, both of Fed. Rep. of Germany; Thomas Bartl, Allschwil, Switzerland

[73] Assignee: Crown Cork AG, Reinach, Switzerland

[21] Appl. No.: 680,299

[22] Filed: Apr. 4, 1991

[30] Foreign Application Priority Data

Apr. 4, 1990 [CH] Switzerland ..... 1133/90

[51] Int. Cl.[5] ..... B65D 41/34

[52] U.S. Cl. ..... 215/252

[58] Field of Search ..... 215/252, 253, 258

[56] References Cited

U.S. PATENT DOCUMENTS

| | | | |
|---|---|---|---|
| 4,432,461 | 2/1984 | Mumford et al. | 215/252 |
| 4,756,438 | 7/1988 | Ryder | 215/252 |
| 4,784,280 | 11/1988 | Breuer et al. | 215/252 |
| 4,923,073 | 5/1990 | Wilde | 215/252 |
| 4,967,920 | 11/1990 | Dahl | 215/252 |

FOREIGN PATENT DOCUMENTS

| | | | |
|---|---|---|---|
| 0094026 | 11/1983 | European Pat. Off. | 215/252 |

*Primary Examiner*—Stephen Marcus
*Assistant Examiner*—Nova Stucker
*Attorney, Agent, or Firm*—Woodcock, Washburn, Kurtz, Mackiewicz & Norris

[57] ABSTRACT

A closure cap made of plastic is provided with an anti-tamper strip. The closure cap and the anti-tamper strip are connected together by connecting ribs. The connecting ribs are weakened on a side which is oriented towards a prescribed tearing position.

10 Claims, 5 Drawing Sheets

PLASTIC CLOSURE CAP

FIELD OF THE INVENTION

The present invention is directed in general to a closure cap made from plastic with an anti-tamper strip or tamper evident strip.

BACKGROUND OF THE INVENTION

Plastic closure caps, with an anti-tamper strip connected to the cap by numerous connecting ribs, are increasingly successful with consumers. With such closure caps, an anti-tamper strip is formed in such a way that it is fastened to the neck of the container either through heat shrinking around the container neck, through an interlocking engagement with the neck, or through shaping onto corresponding beads, cams or into undercuts on the container neck. When the closure cap is opened for the first time, a resistance caused by the anti-tamper strip's connection to the container neck results in a tearing of at least some of the connecting ribs. In this way, the initial opening of the closure cap is demonstrated and tamper evidence is achieved.

With some anti-tamper strip closure caps, a vertical predetermined breaking line (or numerous vertical predetermined breaking lines) is also provided on the antitamper strip itself, in addition to the connecting ribs. Closure caps are already known not only in the form of screw caps with internal threads, but also in the form of snap caps and caps with other kinds of attachment onto the container neck (for example, bayonet-type engagement).

One embodiment of such a closure cap is described in European Patent No. 154 603. A screw cap with a so-called mechanical anti-tamper strip is shown there which, with numerous holding cams and a bead on the anti-tamper strip, snaps over a complementary bead on the container neck when attached for the first time. The anti-tamper strip is permanently attached to the screw cap on one side by a rib.

The anti-tamper strips of the closure cap embodiment described in European Patent No. 154 603, as well as the other types and derivations of the kinds of closure caps mentioned above, require further improvement. One problem of such known closure caps is that the connecting ribs must, on the one hand, be sufficiently firm and capable of bearing a load that they are not torn or damaged through routine handling, upon ejection from an injection mold, during storage in large containers, when screwed onto the bottle, when snapped over a bead on the container, or when heat shrunk onto the container. On the other hand, each connecting rib must be extremely sensitive to all kinds of tension loading in order to tear as promptly as possible when unscrewing of the closure cap from the bottle is commenced for the first time. Only in this way can such closure caps reliably fulfill their tamper evident function. These contradictory demands are difficult to realize, and are especially difficult to achieve in the case of mechanical anti-tamper strips. When closure caps having mechanical tamper evident strips are screwed onto the bottle a relatively high loading is exerted on the connecting ribs as the anti-tamper strip snaps over the complementary bead on the bottle or the container.

The present invention serves the purpose of avoiding these known disadvantages, especially therefore to create a closure cap of the type as described above, which on the one hand properly fulfills its function as an anti-tamper strip, i.e. thus tears quickly and reliably during opening, and yet on the other hand exhibits sufficient stability to withstand the entire production and handling procedure.

SUMMARY OF THE INVENTION

According to the present invention, a closure cap is provided that includes numerous connecting ribs. In fact, according to the present invention, there are at least two, and preferably at least four, connecting ribs. At least two of the ribs which neighbor on a definite position on the tamper evident strip are weakened on the sides thereof which are oriented towards that position. This weakening of the sides of the ribs insures a greater tendency to tear during the opening procedure, so that whenever tension is exerted from this position onto the anti-tamper strip, a tear will more or less spread out from the mentioned position, sideways through the neighboring and subsequent connecting ribs.

According to the present invention, a means is preferably provided to provoke commencement of the tear at a definite position on the circumference of the anti-tamper strip. This can, for example, be achieved in that in one position the holding cam is so formed, in particular raised or inset, that an increased tension is introduced to the antitamper strip at this point when opening. In one embodiment, the anti-tamper strip is connected to a screw cap firmly and permanently at one or more positions, so that during opening the cap is forced to "dodge" to the opposite side, and to exert an increased load there which will then provoke commencement of the tear at this position. This effect can be obtained in a particularly effective way if the region of firm connection provided between the anti-tamper band and the screw cap extends through an angle at the circumference of 130° and 240° . Especially good results are obtained with angles of between 180° and 210° .

According to an alternate embodiment of the present invention, the anti-tamper strip is more or less divided into two or three sections, of which each is permanently connected with the screw cap by means of a firm rib and is then provided, through appropriate means, with points of predetermined tear commencement within the segments marked by these firm ribs.

The present invention can be realized technically in an especially simple way if the connecting ribs are diminished in cross section towards the point of the anticipated tear commencement. The ribs can, therefore, for example, be "wedge shaped" in cross section. In this connection, "wedge shaped" also includes such configurations with which one or more of the side surfaces of the wedge can have a concave or convex curvature. Essentially, it is of primary importance that, in each case, the side of the connecting rib which is oriented away from the prescribed tearing point is formed to be thicker and mechanically firmer than the side oriented towards the prescribed tearing point. It is also important that at most two neighboring ribs are symmetrically weakened towards the position of tearing. There can be cases in which it is sufficient to form both the connecting ribs which immediately neighbor the planned tearing positions in the described way, and to form the remaining ribs in the normal way. This is possible because, with antitamper strips, it is the commencement of tearing that is mainly critical. As soon as the anti-tamper band is torn for the first time and sags at a position P or runs inclined to the screw cap, the free cross section contracts and tilts beneath the complementary bead on the bottle neck. It can then no longer (as would have been possible, for example, at the commencement of the opening procedure) lift parallel with the cap and be snapped upwards over the complementary bead of the bottle neck.

If the cross section of the connecting rib is approximately wedge shaped, a wedge angle of approximately between 15 and 30°, and preferably approximately 20., is particularly suitable for the present invention. It has shown itself that wedge shaped ribs with this angle tear relatively quickly under tension, whilst the thickened side, oriented away from the tearing position, is sufficiently robust to ensure manipulation and handling of the screw cap not only before mounting to the bottle but also during mounting without breakage of the connecting ribs.

The connecting ribs can, however, also be weakened in other ways, and for example, can be cut horizontally or provided with one or more notches.

BRIEF DESCRIPTION OF THE DRAWINGS

Embodiments of the present invention are more closely described in the following drawings in which.

DETAILED DESCRIPTION OF THE PREFERRED EMBODIMENT

Figure 1:
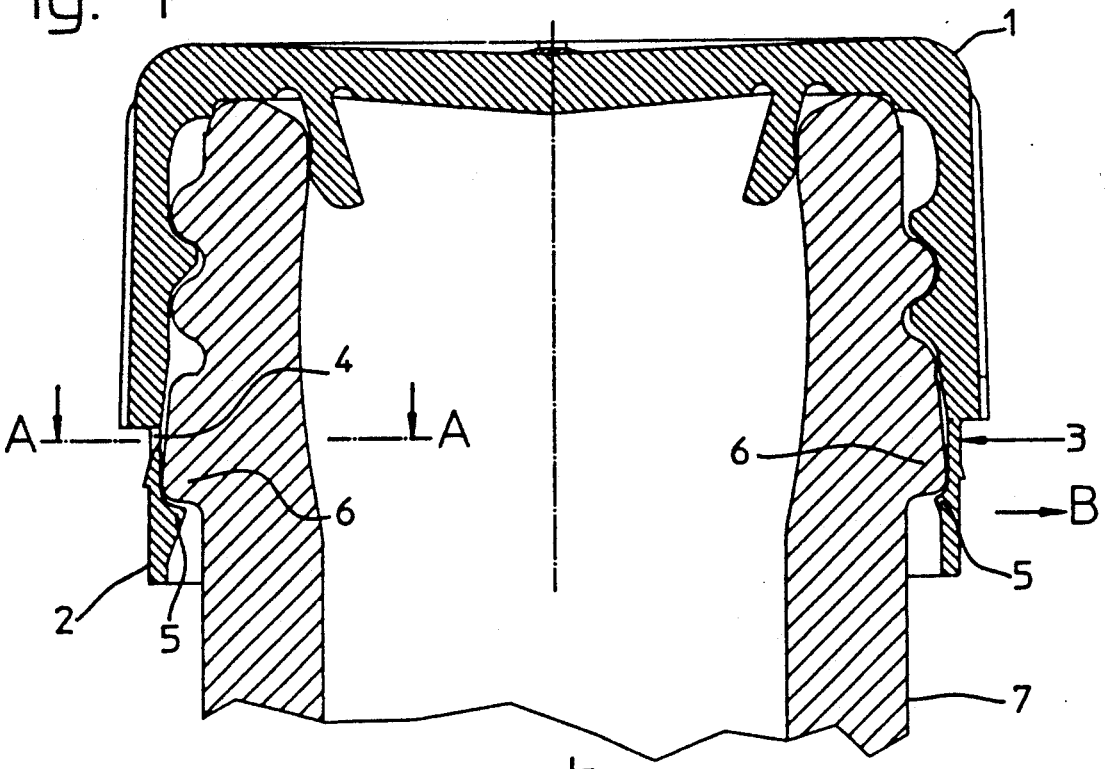
FIG. 1 is a schematic representation of a cross section through a closure cap with the features of the invention.
Figure 2:
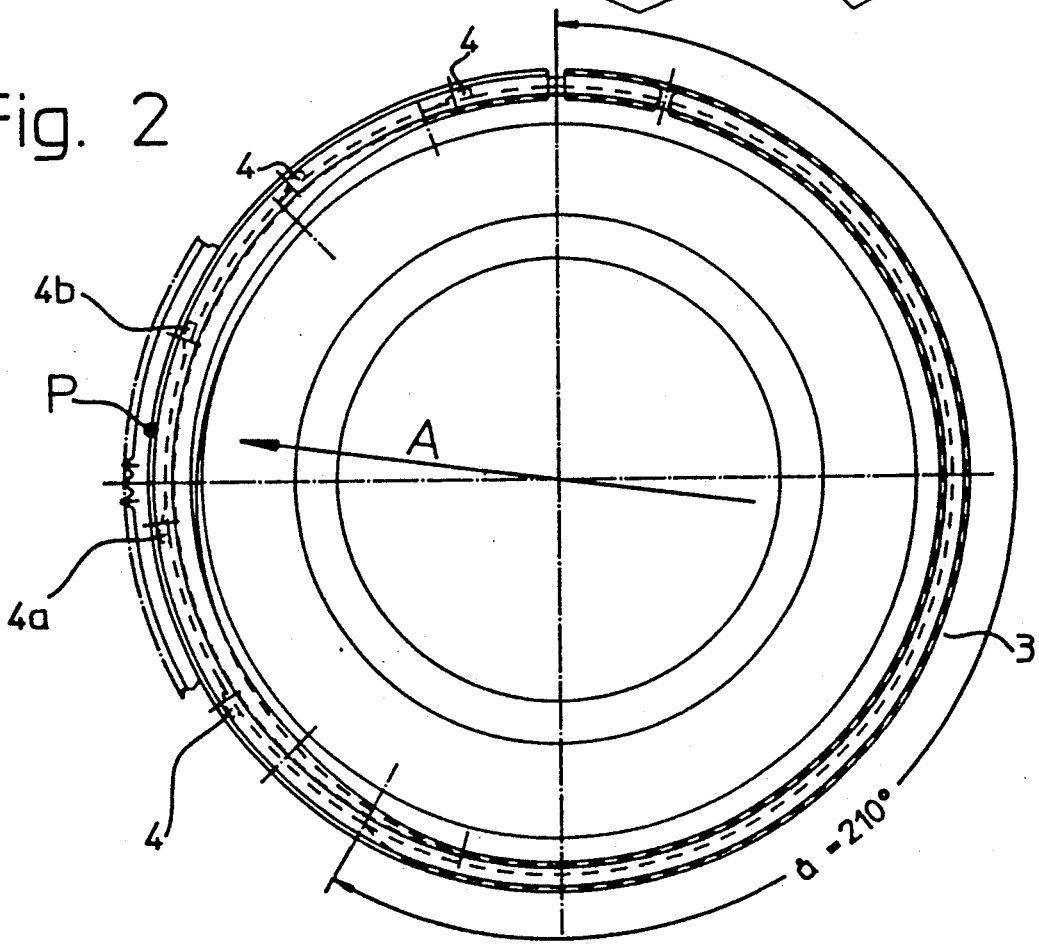
FIG. 2 is a bottom view of the closure cap according to FIG. 1.

According to FIGS. 1 and 2, a closure cap 1, manufactured by the injection molding method, is provided with a anti-tamper strip 2. Through an angle, Alpha, about the circumference of the closure cap, the closure cap 1 is permanently connected to the anti-tamper strip 2 by means of a rib section 3. In the preferred embodiment of the present invention, the angle, Alpha, is 210° as shown in FIG. 2. In the area of the remaining angle of the circumference, the anti-tamper strip is connected by five breakable connecting ribs 4 rather than by the permanently connected rib section 3.

The anti-tamper strip 2 includes a surrounding bead 5 on its inner side with which the anti-tamper strip 2 can engage under a complementary bead 6 on a drink bottle or container. The surrounding bead 5 extends downwardly at an acute angle, so that, when applied to the bottle, the antitamper strip 2 is slowly expanded either when the closure cap is screwed onto the bottle or snapped over the complementary bead 6 on the bottle neck.

Since the anti-tamper strip 2 is provided with the surrounding bead 5 in the region of the rib section 3, when the bottle is opened for the first time, an increased tension is exerted on the anti-tamper strip 2 approximately in the direction of the arrow A (FIG. 2) on the side of the antitamper strip lying opposite to the rib section 3. The result is that when unscrewing the closure cap from the bottle, the surrounding bead 5 in the region of the ribs 4 comes into contact more intensely with the complementary bead 6 on the bottle neck 7, due also in part to the enlargement of the surrounding bead 5 in this region. Apart from that, when unscrewing the closure cap from the bottle, the surrounding bead 5 in the rib region 3 is pressed away from the bottle in the direction of arrow B (FIG. 1). Thus, the anti-tamper strip 2 comes into contact with the bottle more intensely on the opposite side near position (P) (FIG. 2) and tears more reliably at the commencement of opening at this location. The tearing of the connecting ribs 4 is therefore provoked, especially in the region between the two connecting ribs 4*a* and 4*b*.

Figure 3A:
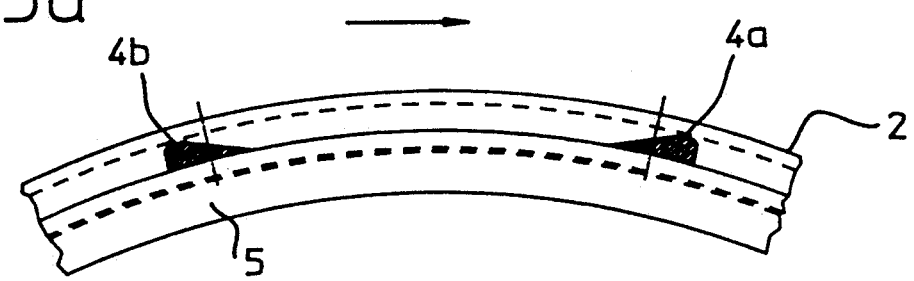
FIG. 3*a* is an enlarged cross sectional view along the line A-A of the closure cap according to FIG. 1.

As is particularly easy to observe in FIGS. 2 and 3*a*, the connecting ribs 4 are approximately wedge shaped in cross section, whereby all ribs are aligned with their wedge tips, that means therefore their thinner and weaker edges, towards the position (P) where the tear procedure shall initiate.

Figure 3B:
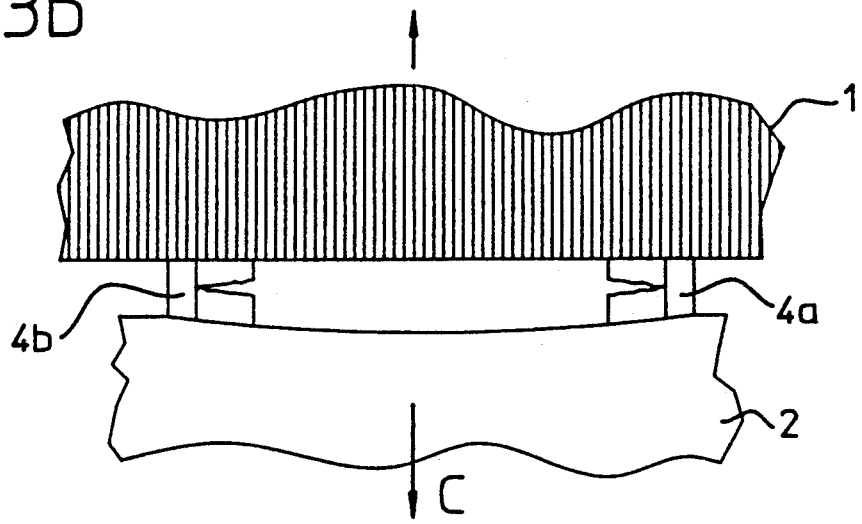
FIG. 3*b* is a side view of the representation according to FIG. 3*a*.

As is particularly easy to observe in FIG. 3*b*, the anti-tamper strip 2 forms a downward sagging "strap" in the direction of arrow C after commencement of the tearing procedure, because the cap tilts somewhat on the bottle neck. As soon as this position is reached, the tear procedure spreads itself rapidly out from position (P) through the other ribs 4 if the closure cap is further opened. This strap formation in the direction of the arrow C may also be observed in FIG. 4.

The connecting ribs 4 which taper in the direction of position (P) are provided with a thickened cross section which is oriented away from position (P) and which ensures that the anti-tamper strip 2 is not damaged either when handling or during manufacture, and in particular when being ejected from an injection molding tool. Thus, the connecting ribs 4 do not break or tear during these operations.

Naturally, the cross section of the anti-tamper strip can also be modified, thus the taper to the "wedge tip" can be formed to be more acute or to be blunter according to the material employed or the configuration of the cap. Also, the thickness and total length of the rib 4, as well as the width of the strengthened end which is oriented away from the point B, can be adjusted to the special characteristics, in particular to the tearing resistance of the plastic used and to the load carrying ability of the connection between the anti-tamper strip and the container.

Also the length of the rib section 3 can be optimized in a clear way through simple trials. Thus, angles of circumference Alpha of 170 and 210 have allowed good results to be obtained.

Figure 4:
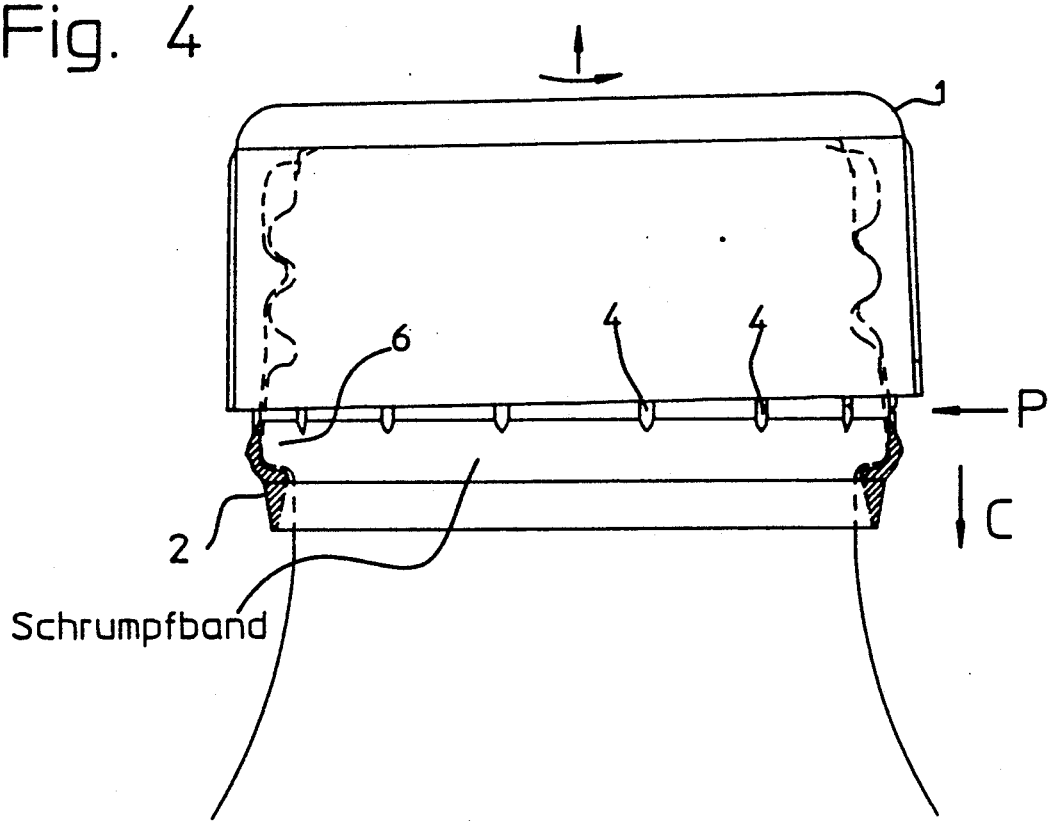
FIG. 4 is a partial cross sectional view of a closure cap according to the present invention shown mounted to the screw thread of a bottle at the instance of unscrewing from the bottle.

FIG. 4 shows an embodiment of the present invention with which, in a known way, a hot formable antitamper strip 2 is re-contracted or formed beneath a bead 6 on the container neck 7 through pressing or shrinkage. The cross sectional shape of the connecting ribs 4 correspond to the embodiment according to FIGS. 1 to 3.

Figure 5A:
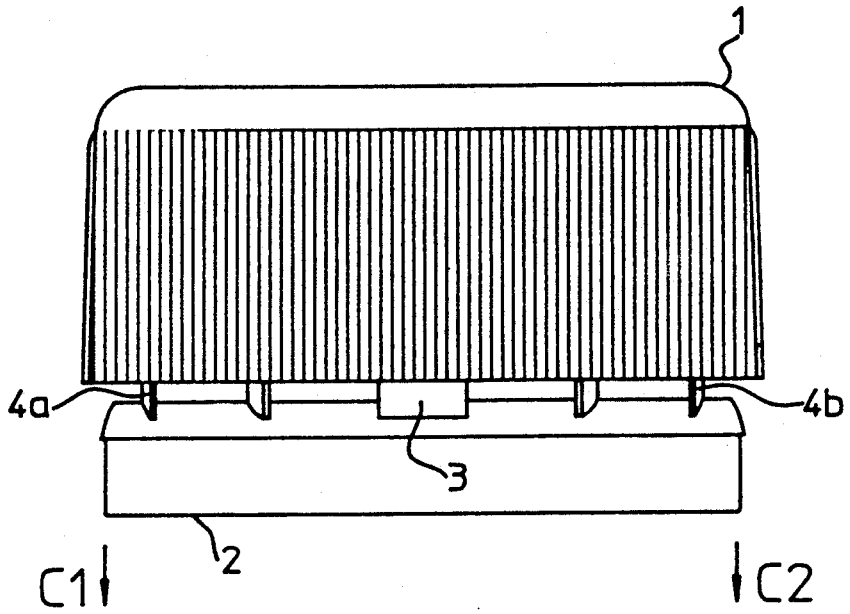
FIG. 5*a* is a side view a screw cap according to a second embodiment of the present invention having two permanent connecting ribs.
Figure 5B:
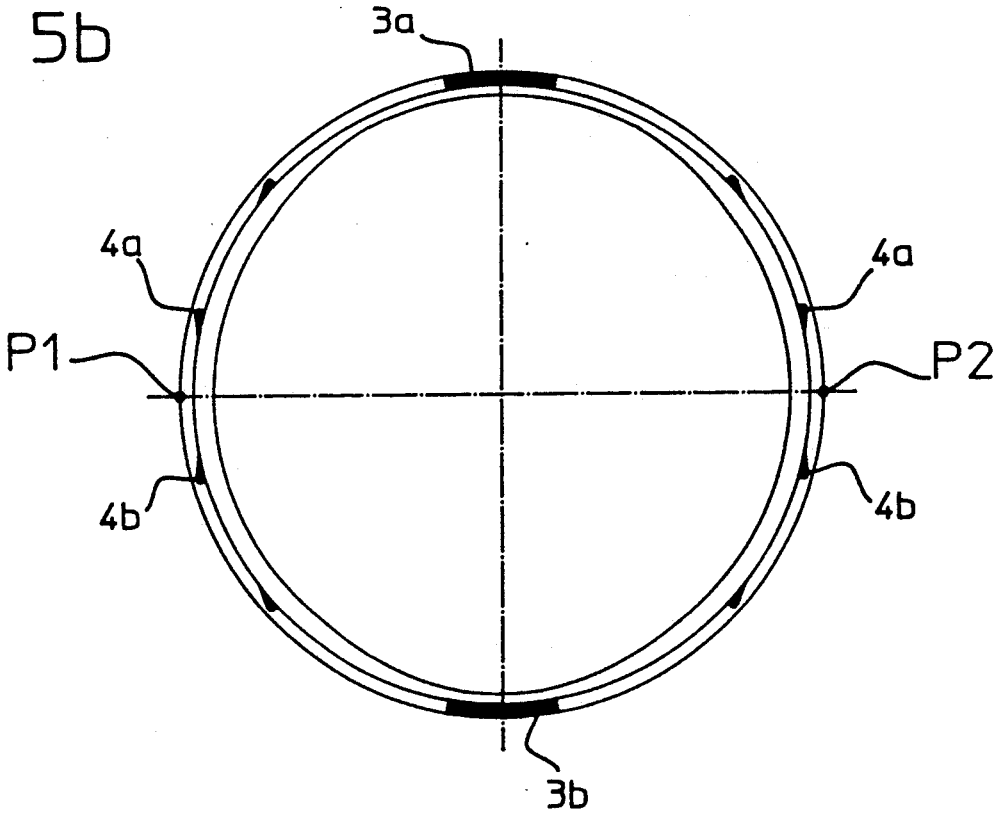
FIG. 5*b* is a bottom view of the closure cap according to FIG. 5*a*.

FIGS. 5*a* and 5*b* show a modified embodiment of the present invention in which two relatively narrow rib sections 3*a* and 3*b* are provided. In this case, the previously described "strap formation", when opening the cap, initiates at both points P1 and P2 and in the direction of arrows C1 and C2 between both the rib sections 3*a* and 3*b*. For this reason, the connecting ribs 4*a* and 4*b*, which are wedge shaped in cross section analogue to the embodiment shown in FIGS. 1 to 4, are aligned such that the tips thereof are directed respectively towards the points P1 and P2, so that the tearing procedure can be reliably initiated there.

Figure 6:
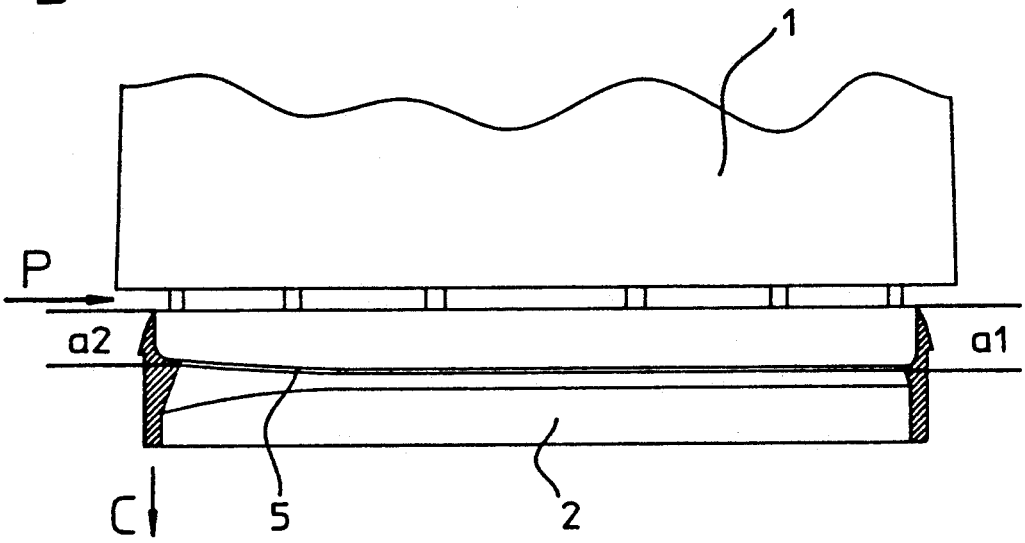
FIG. 6 is a schematic representation of a closure cap having a mechanical anti-tamper strip.

FIG. 6 shows an alternate embodiment of the present invention of a closure cap 1 in which the distance a2 of the zenith of the surrounding bead 5 to the upper edge of the anti-tamper strip is less in the region of position (P) than the distance al on the opposite side thereof. Consequently, when unscrewing the closure cap from the bottle, the surrounding bead 5 will first come into contact with the complementary bead 6 (FIG. 1) on the bottle neck 7 in the region of the smaller distance a2. The pull on the antitamper strip 2 initiates, therefore, in the region of the position (P), so that the strap formation ensues in the direction of the arrow C (FIG. 6).

Thus, with the embodiment according to FIGS. 5*a* and 5*b*, the commencement of tearing is solely determined by the fact that the expansion and strap formation of the antitamper strip 2 commences in the region of greatest weakness, in other words, at the points Pl and P2. In the case the embodiment according to FIG. 6, as well as with the embodiment according to FIGS. 1 to 4, a means is provided to specifically provoke commencement of tearing at a definite point. This may also be achieved through cams or deeper bead formation.

Figure 7A:
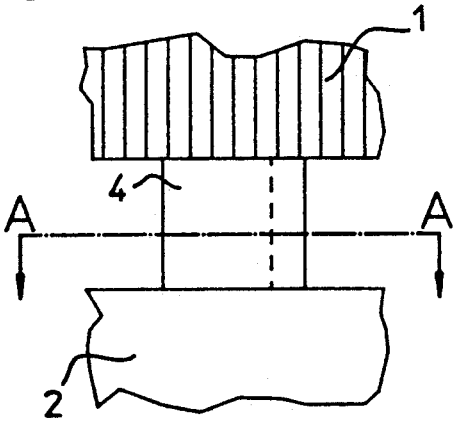
FIG. 7*a* is a schematic representation of a connecting rib with wedge shaped tapering tip.
Figure 7B:
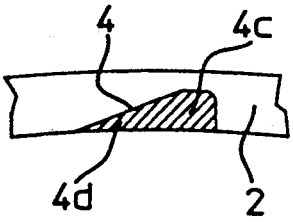
FIG. 7*b* is a cross sectional view along section A-A of the connecting rib of FIG. 7*a*.

FIGS. 7*a* and 7*b* show the shape of the connecting ribs 4 schematically and with an enlarged scale. The connecting ribs 4 are consequently formed with an approximately rectangular cross section 4*c*, which blends into a section running to a tip in which the plastic material, because of its elasticity, is especially capable of expansion and thereby tends to yield. This expansion leads to the previously described strap formation out of which the tear procedure derives.

Figure 8A:
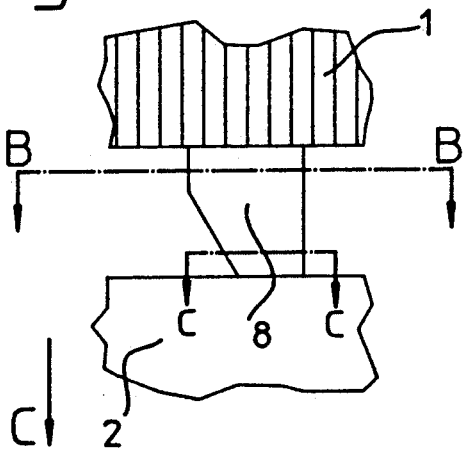
FIG. 8*a* is a schematic representation of a modified embodiment of a connecting rib.
Figure 8B:
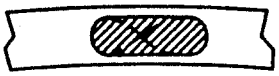
FIG. 8*b* is a cross sectional view of the connecting rib of FIG. 8*a* taken along section line B-B.
Figure 8C:
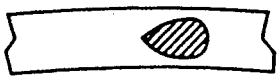
FIG. 8*c* is a cross sectional view of the connecting rib of FIG. 8*a* taken along section line C-C.

FIG. 8 shows a related embodiment with which the ribs 4 are additionally weakened through a notch 8 set into their lower region. Each pull in the direction of the arrow C allows the anti-tamper strip 2 to tilt downwards, whereby the commencement of the tear is initiated.

Naturally, the notching can possess another geometric form and, for example, can be provided in the middle section of the connecting rib 4. The weakness could be formed as a perforation on one side of the connecting rib 4 or could also subsequently be applied in the form of an incision. It is above all important that at least two of the connecting ribs 4 are, on their sides which orient towards each other, weakened in such a way at the commencement of the unscrewing procedure that an increased expansion is initiated there and strap formation of the anti-tamper strip is made possible.

Figure 9:
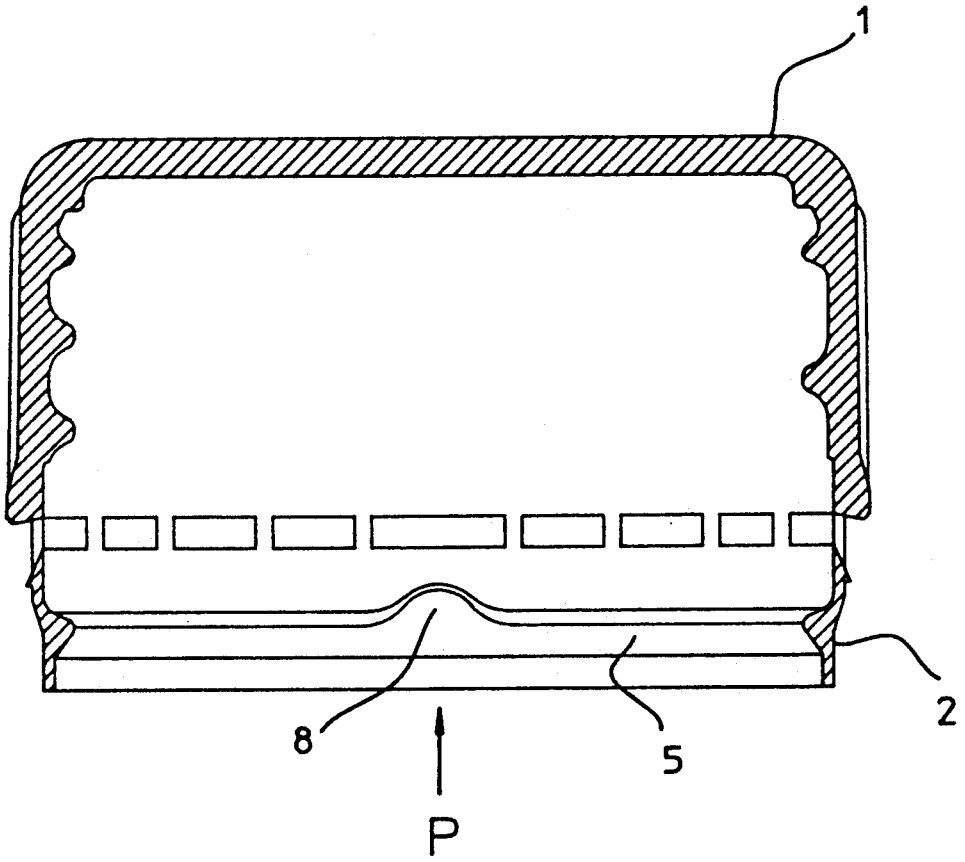
FIG. 9 is a cross section view of a further modified embodiment of the closure cap of the present invention.

FIG. 9 shows an embodiment of a closure cap 1 with anti-tamper strip 2 with an inner bead 5. On the inner bead 5 a raised section 8 is provided which causes firmer and earlier contact with the complementary bead 6 (FIG. 1) of a container neck 7 at this position. When opening the closure cap, the tension is initiated on the anti-tamper strip 2 in the region of the raised section 8, by which the prescribed tear formation is predetermined there, at position (P).

What is claimed is:

1. A closure cap made from plastic comprising:

an anti-tamper strip which may be brought into contact with one or more retaining elements on a container neck, said strip having at least one position (P) on its circumference;

a plurality of connecting ribs joining said strip to said cap and which break or tear when the container is being opened for the first time, said ribs having a cross section which is weaker on the side oriented towards said position (P) than on the side oriented away from said position.

2. The closure cap according to claim 1 wherein said position (P) is the position of the commencement of tearing on the circumference of the anti-tamper strip, and wherein at least the connecting ribs neighboring the position (P) exhibit a cross section which is weakened on the side oriented towards the position (P).

3. The closure cap according to claim 2 wherein the cross section of the connecting ribs diminishes towards the position (P) of the commencement of tearing.

4. The closure cap according to claim 2 wherein the connecting ribs are approximately wedge shaped in cross section, whereby the tip of the wedge is oriented toward the position (P) of the commencement of tearing.

5. The closure cap according to claim 4 wherein the wedge angle of the cross section of said connecting ribs ranges between approximately 15° and 30° .

6. The closure cap according to claim 5 wherein the wedge angle is approximately 20° .

7. The closure cap according to claim 2 wherein the anti-tamper strip, on a side approximately opposite the position (P) of the commencement of tearing of the antitamper strip, is provided with at least one rib section which firmly connects the anti-tamper strip with the cap and which extends through a defined arc about the circumference of the closure cap to thereby determine the position (P) of the prescribed commencement of tearing.

8. The closure cap according to claim 7 having at least such two rib sections.

9. The closure cap according to claim 7 wherein said defined arc ranges between approximately 180° -240° .

10. The closure cap according to claim 7 wherein said defined arc ranges between 180° – 210°.

* * * * *

UNITED STATES PATENT AND TRADEMARK OFFICE

CERTIFICATE OF CORRECTION

PATENT NO. : 5,074,425

DATED : December 24, 1991

INVENTOR(S) : Günter Wüstmann; Michael Kirchgessner; Thomas Bartl

It is certified that error appears in the above-identified patent and that said Letters Patent is hereby corrected as shown below:

Column 3, line 10, delete "15" and substitute therefor -- 15° --;

Column 3, line 10, delete "20." and substitute therefor -- 20° --;

Column 5, line 1, delete "170 and 210" and substitute therefor -- 170° and 210° --.

Signed and Sealed this

Thirtieth Day of March, 1993

*Attest:*

STEPHEN G. KUNIN

*Attesting Officer*

*Acting Commissioner of Patents and Trademarks*